US011391051B2

(12) United States Patent
Stathis

(10) Patent No.: US 11,391,051 B2
(45) Date of Patent: Jul. 19, 2022

(54) CONTOUR SPACKLE KNIFE

(71) Applicant: Shark Toolers, Morris Plains, NJ (US)

(72) Inventor: James Stathis, Morris Plains, NJ (US)

( * ) Notice: Subject to any disclaimer, the term of this patent is extended or adjusted under 35 U.S.C. 154(b) by 211 days.

(21) Appl. No.: 16/778,261

(22) Filed: Jan. 31, 2020

(65) Prior Publication Data

US 2021/0238867 A1 Aug. 5, 2021

(51) Int. Cl.
*E04F 21/165* (2006.01)
*B25G 1/10* (2006.01)

(52) U.S. Cl.
CPC ..... *E04F 21/1652* (2013.01); *B25G 1/102* (2013.01)

(58) Field of Classification Search
CPC ..... E04F 21/165; E04F 21/1652; E04F 21/16; A47L 13/02; A47L 13/022; A47L 13/08; B25G 1/102; A47J 43/288
USPC ..... 15/145, 245.1, 235.3, 236.07, 236.01, 15/245; D32/46; 16/430
See application file for complete search history.

(56) References Cited

U.S. PATENT DOCUMENTS

| | | | | |
|---|---|---|---|---|
| 3,878,581 | A * | 4/1975 | Perna | E04F 21/161 15/235.7 |
| 4,784,598 | A | 11/1988 | Kranz | |
| 4,817,229 | A * | 4/1989 | Sedillo | E04F 21/165 15/144.1 |
| 6,240,591 | B1 | 6/2001 | Maxted | |
| 8,205,341 | B2 * | 6/2012 | Rosso | E04F 21/1652 30/169 |
| 8,266,758 | B2 | 9/2012 | Hoffman | |
| 10,300,592 | B2 * | 5/2019 | Hayes | B25G 1/102 |
| 10,526,800 | B2 * | 1/2020 | Hernandez | E04F 21/1652 |
| 2008/0229535 | A1 | 9/2008 | Walter | |

* cited by examiner

*Primary Examiner* — Lee D Wilson
*Assistant Examiner* — Alberto Saenz
(74) *Attorney, Agent, or Firm* — Baldini Law, LLC

(57) ABSTRACT

A simple, hand-held tool for applying drywall compound or other spackle type cement or adhesive substance into a tight space through the entire length and height of the space, such as in a corner next to molding or other obstruction. The device as described may be fashioned in various widths at its applicator end to accommodate various widths of such spaces.

7 Claims, 6 Drawing Sheets

CONTOUR SPACKLE KNIFE

FIELD OF THE INVENTION

A simple, hand-held tool for applying drywall compound or other spackle type cement or adhesive substances into a tight space through the entire length and height of the space, such as in a corner next to molding or other obstruction. The device as described may be fashioned in various widths at its applicator end to accommodate various widths of such spaces.

BACKGROUND

Constructing walls from drywall, or otherwise known as sheetrock, is a common building practice. This construction, among other things, involves spreading drywall compound, or otherwise known as spackle or mastic, at various places over the drywall, most typically, at joints or seams, over drywall tape, over nail heads, and essentially anywhere there is needed some smoothing out to provide a fully smooth, uniform, continuous surface to accept paint or other wall covering.

Drywall compound is a spreadable, gypsum based mud mixture, the consistency of soft clay or mud. It is typically spread with a trowel type tool, sometimes referred to as a drywall spackle knife or putty knife. It essentially consists of a tool handle with a wide flat blade at the other end. Generally, the wider the blade, the easier it is to uniformly apply the compound over large flat areas, typically at least wide enough to fully cross over the width of a joint seam drywall tape. Sometimes however, there is a need to apply compound in a tight space, such as in an inside corner next to a door frame where the space is only ¼" wide or other small area.

Spreading joint compound or mastic with a spackle knife is best accomplished with a thin knife that has the right combination of flexibility and strength. The blade should be stiff enough to firmly apply the compound to the wall surface securely, but also flexible enough to provide some tension, allowing the blade to push the compound into cracks and crevices. The installer will then apply a bit of downward pressure, bending the blade slightly, as the blade is moved over the wall, to best accomplish this in an even, uniform manner with ease. In order to apply this desired pressure, it is easiest if the pressure is applied in-line with the handle and the blade. However, when trying to apply compound in tight spaces and at corners, the edge of the blade, the handle, or a hand or arm that is holding the handle, can get obstructed by adjacent walls, woodwork, or other obstructions making it difficult to maneuver the spackle knife with any pressure, or uniformly. Sometimes, installers resort to using their fingers to spread joint compound in these areas.

There have been attempts to solve the difficulties noted of applying joint compound in other than large flat surface areas. For example, U.S. Patent Application Serial No. US 2008/0229535 A1 titled SELF TAPERING FINISHING KNIFE, discloses, "a tool and method for applying a compound to a surface on which the tapering of the compound is useful for correct finishing. This novel tool and method, when applied to a trade such as drywall finishing, reduces labor time, skill level required, and material consumption to complete the task. The tool and method are generally useful for providing tapered compound and are particularly adapted for the finishing of inside corners, butted seams, and wall hole repairs when tapering of the finishing compound is required."

In another example, U.S. Pat. No. 4,784,598, titled DRYWALL TOOL, discloses, "a tool for applying drywall compound to a drywall [joint]. The tool includes an application member of resilient flexible material. The member has a generally flat application surface and an arcuate application edge. The application edge and the thickness of the application member are selected for a central portion of the edge to be urged against a joint defined by contiguous flat drywall sheets. The application surface on opposite sides of the central portion flex to define a smooth continuous surface from the central portion to points on the drywall sheets spaced from the joint. The tool urges drywall compound within the joint to assume a smooth surface filling the joint and fanned away from the joint into smooth continuity with the drywall sheets."

In another example, U.S. Pat. No. 6,240,591 B1, titled BULL-NOSED CLEANING, AND COVING, DRYWALL TOOL, discloses, "a handheld, durable, easy-maintenance, easy-hold, precision-contour drywall finishing tool substantially in the shape of a round disk presents both convex and concave, or bull-nose, peripheral regions respectively [sic] suitable for coving, and for cleaning, flowable building material within, respectively, concave wall joints >90° and <180° nominally 135°, and convex wall joints >180° and <270° nominally 225°. The disk is preferably about 12 cm. in diameter, with its otherwise circular peripheral edge relieved over about 45° of arc in the shape of a concave curve, or bull nose, of some 3.5 cm diameter. Preferably one major surface of the disk is flat while the opposing surface slopes radially symmetrically from a central region of greater thickness, about 0.75 cm., towards a lesser thickness, about 3 mm., at the edge of the disk. A feature, preferably a knob of about 0.75 cm height by 3 cm. diameter integrally molded at the center of the disks sloping surface, abets grasping and holding the tool with the hand and fingers so as to force and to draw the tool, which flexes and bends slightly backward, against flowable building material during dry wall construction so as to, dependent upon rotational orientation of the tool, contour the flowable building material into either the concave or convex wall joints."

Finally, in another example, U.S. Pat. No. 8,266,758, titled ADJUSTABLE SPATULA FOR FORMING A SMOOTHLY ARCUATE CONCAVE CONTOUR IN A VISCOUS MATERIAL AND A SMOOTHLY ARCUATE CONVEX CONTOUR IN THE VISCOUS MATERIAL discloses, "an adjustable spatula for forming a smoothly arcuate concave contour in a viscous material and a smoothly arcuate convex contour in the viscous material, independently of each other, with a certainty that the contour of the viscous material is consistent, and with using only one hand. The adjustable spatula includes a blade, a handle, and an apparatus. The handle extends from the blade and is gripped by a user. The apparatus bends the blade to form the blade into a smoothly arcuate convex contour to form the smoothly arcuate concave contour in the viscous material and bends the blade to form the blade into a smoothly arcuate concave contour to form the smoothly arcuate convex contour in the viscous material, independently of each other, without a need for the user to have to manually bend the blade, with the certainty that the contour of the viscous material is consistent, and with using only the one hand."

None of the foregoing references, alone or in combination, teach the salient and proprietary features or construction of the present disclosure, and as such, fail to be useful as a tool to properly assist a joint compound installer in applying joint compound in tight spaces. In fact, there seems to be a complete void of such products, other than using a finger, a screwdriver, or other such ill-designed tool for the purpose.

The present disclosure teaches several embodiments that provide a proprietary handle, easy to hold, even if hands are sticky or wet, that holds an offset, contour spackle knife tool with a certain pre-defined curvature and desired combination of rigidity and flexibility configured to allow a spackler to spread drywall mud in tight spaces with uniformity and ease.

SUMMARY

The present disclosure teaches embodiments of a device that comprise: (a) a proprietary handle, further comprising, a bulbous shape to fit securely in the palm of one hand with room for fingers to wrap around, and a center indentation where a thumb can rest for easy maneuverability; and (b) an offset curved and contoured blade of specified rigidity/flexibility having an outside edge, and having two ends, a first end that attaches to the proprietary handle and a second opposite end having a predefined width at said second end wherein said outside edge of said second opposite end extends beyond the outside edge of the proprietary handle.

In one embodiment, the second opposite end of the contoured blade is one-quarter inch wide and extends at its outside edge one-eight inch past the outside edge of the proprietary handle.

In other embodiments, the second opposite end of the contoured blade is anywhere from one-sixteenth of an inch wide to two inches wide, preferably between one-quarter inch wide to one inch wide, and may extend anywhere from one-sixteenth inch to one inch past the outside edge of the proprietary handle, preferable approximately one-eighth inch to one-quarter inch.

In one embodiment, the contoured blade is completely rigid with very little flexibility. In an alternative embodiment, the contoured blade is extremely flexible and will bend with very little pressure. In a preferred embodiment, the contoured blade is fairly rigid with some flexibility desired to be able to force drywall compound into small cracks or other spaces with a smooth surface.

In one embodiment, the contoured knife may be formed from a material chosen from any known material that is sturdy yet with the appropriate flexibility at a given thickness, lightweight, easy to manufacture, and durable, such as metal, plastic, plexiglass, or any other such substance. In a preferred embodiment, the material is aluminum.

In one embodiment, the handle can be formed from a material chosen from any known material that is sturdy, durable, lightweight, comfortable in the hand, and easy to manufacture. In one embodiment, the material can be the same as the material chosen for the square sides. In one embodiment, the material can different from the material chosen for the square sides. In a preferred embodiment, the material for the handle is plastic.

In one embodiment, the handle can separate when desired, in order for the contoured blade to be replaceable if it should become damaged or dirty. In one embodiment, the replaceability of the contoured blade could also allow interchangeability of the widths, so that other than one-quarter inch widths to be easily accommodated. In one embodiment, the separability could be enabled through a screw fastener, or a snap together fastener, or any known fastening mechanism for two sides of a handle/bracket.

In one embodiment, the handle could accommodate a plurality of contoured blades that could rotate around a pivot point, such that the user could rotate one blade into a position for use, while the others point 180° in the other direction and out of the way. IN this manner, the user could easily switch between desired widths during use.

DETAILED DESCRIPTION

For clarity of disclosure, and not by way of limitation, the detailed description of the invention is divided into the following subsections that describe or illustrate certain features, embodiments or applications of the present invention.

Definitions

"knife blade" as used herein means the blade or knife end of a spackle knife or putty knife or scraper or spatula like tool used for spreading materials such as drywall compound or plaster into joint seams, cracks, nail head holes, and the like, and may be of any materials, shape, thickness, and/or rigidity.

Figure 1:
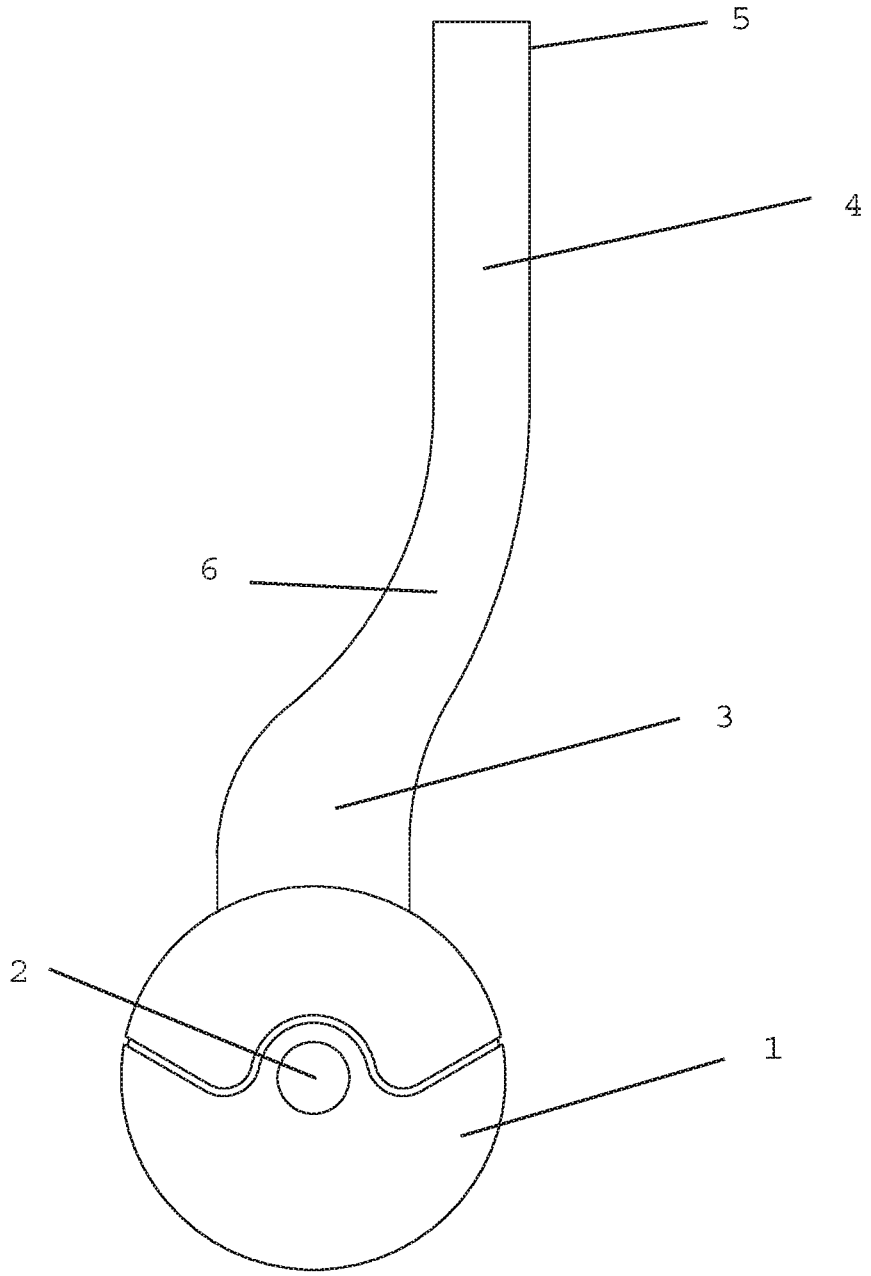
FIG. 1 depicts one embodiment of a contour spackle knife comprising a handle (1) having a center indentation (2) and further comprising an offset curved and contoured blade of specified rigidity/flexibility (6) having an outside edge (5) that extends beyond the outside edge of the proprietary handle and having two ends, a first end that attaches to the proprietary handle (3) and a second opposite end having a predefined width at said second end (4).
Figure 2:
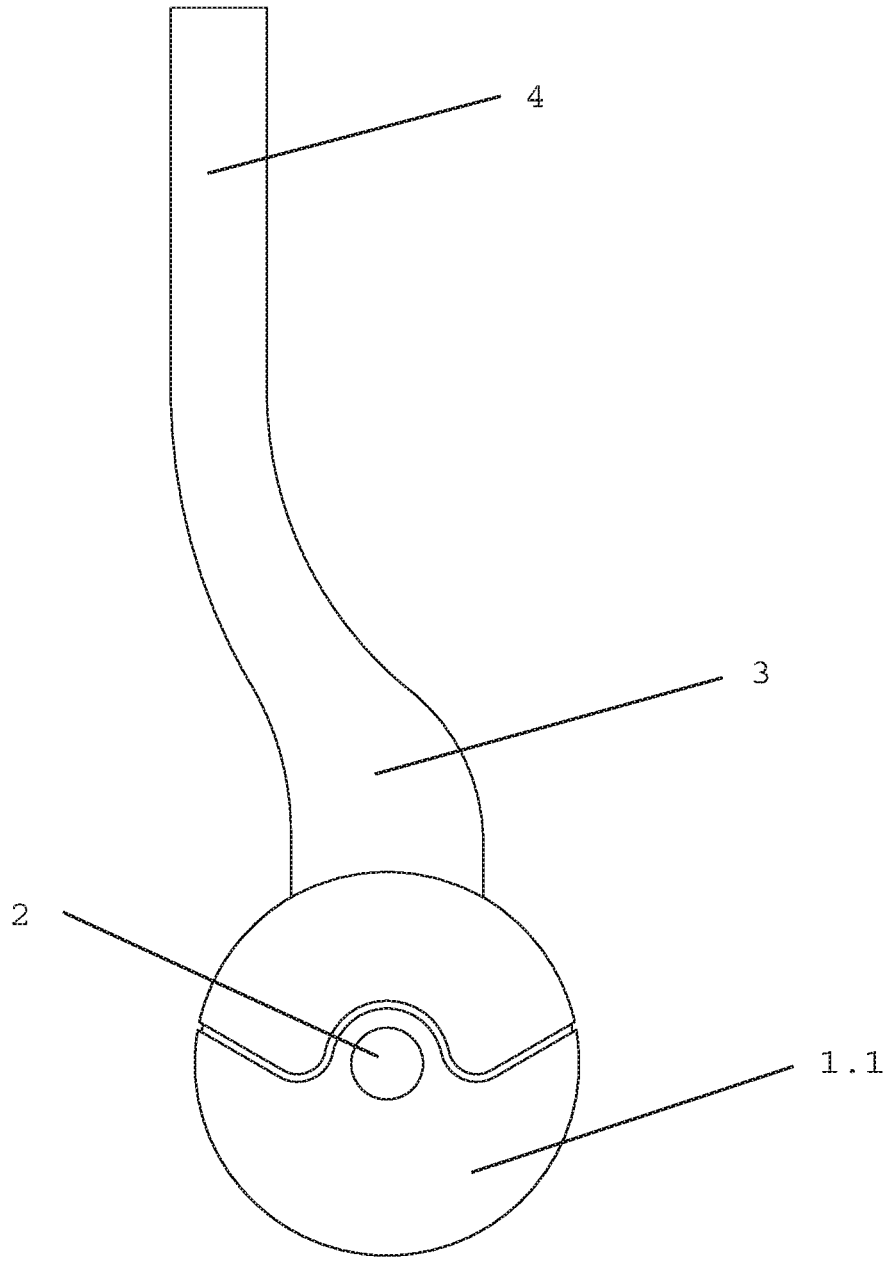
FIG. 2 depicts one embodiment of a contour spackle knife as shown in FIG. 1, but from the other side.
Figure 3:
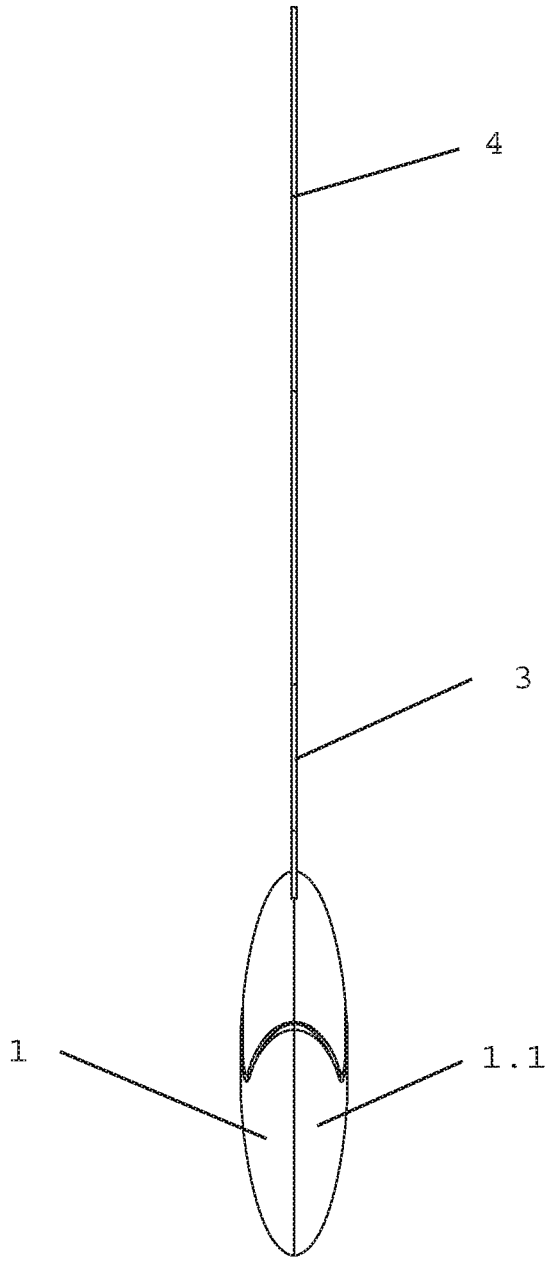
FIG. 3 depicts one embodiment of a contour spackle knife as shown in FIGS. 1 and 2, but from the side.
Figure 4:
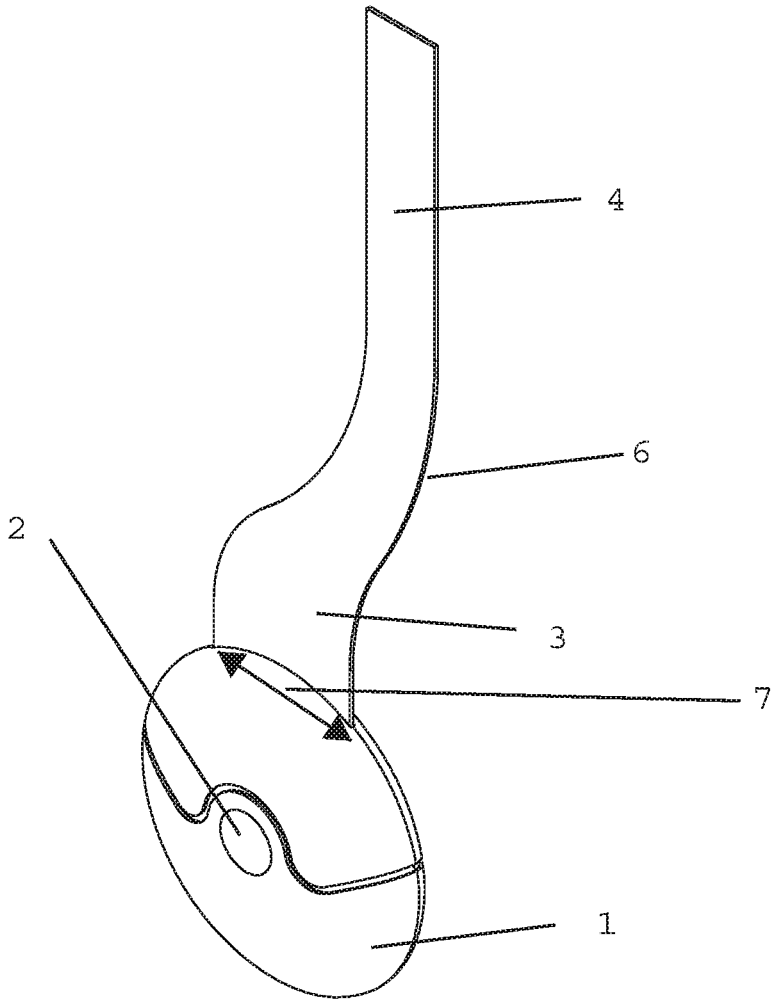
FIG. 4 depicts one embodiment of a contour spackle knife as shown in the previous figures in perspective view.
Figure 5:
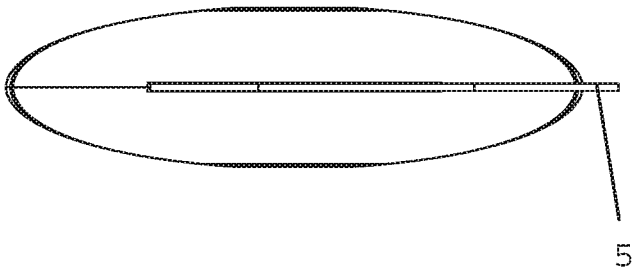
FIG. 5 depicts one embodiment of a contour spackle knife as shown in the previous figures, but from a top view and showing the outside edge (5) of the blade extending beyond the outside edge of the periphery of the handle.
Figure 6:
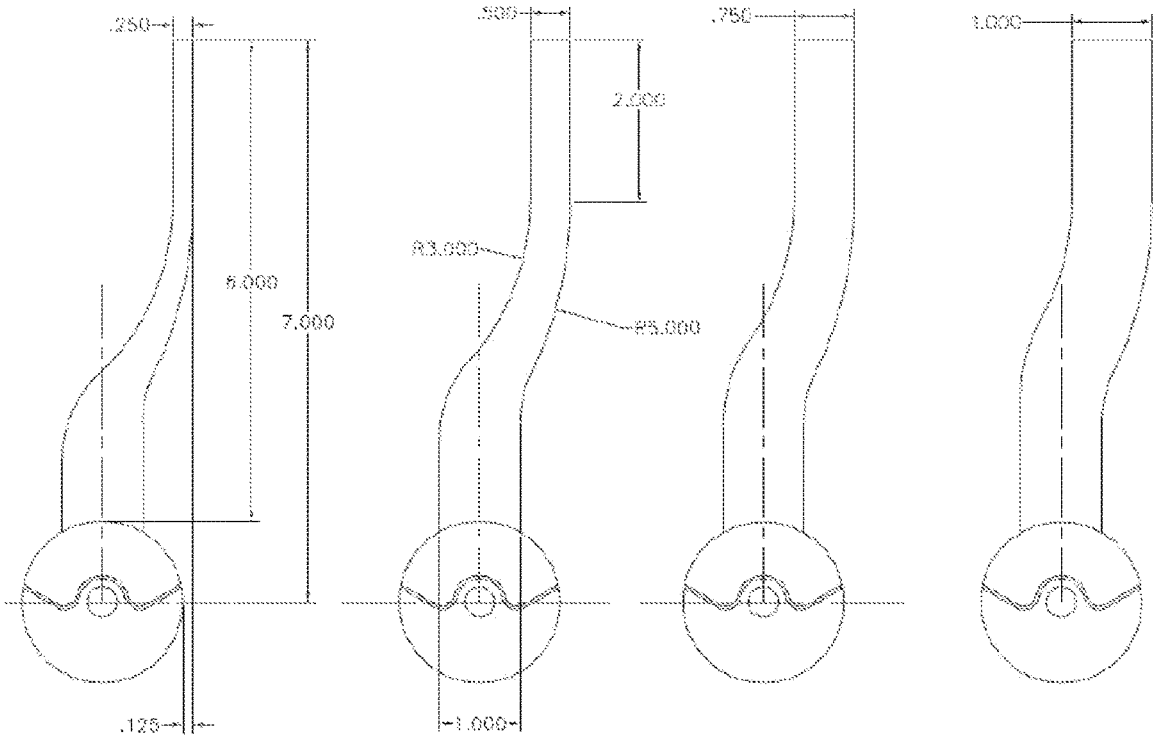
FIG. 6 depicts several embodiments of a contour spackle knife as shown in the previous figures with various dimensions and several non-limiting examples of various widths the second opposite end of the blade may have. The outside edge of the second opposite end of the blade is always extended out from the outside edge of the proprietary handle, in these examples, by ⅛".

"contoured blade" as used herein means a knife blade of a specific shape, substantially as shown in FIG. 6, wherein the blade has a curve such that the second opposite end of the blade has an outside edge that extends beyond the outside edge of a handle to which the first end of the blade attaches.

"proprietary handle" as used herein means a substantially circular, bulbous device, approximately the size to comfortably fit in an average hand, but could be custom sized to fit any hand, comprising a substantially smooth outer surface with an indentation in the center of either or both sides to rest a thumb, and comprising an inner area configured to attach a knife blade.

The System and Method of the Present Invention

A typical device as described herein comprises a proprietary handle (1) with an indentation (2), approximately the size of a large yo-yo, having one-quarter of its circumferential edge (7) hollowed and configured to accept a contoured blade, the contoured blade having a first end (3) that attaches to the proprietary handle, a curved portion (6) that leads to a second opposite end (4) that is of pre-defined width and having an outside edge (5) that extends out past the outer circumferential edge of the proprietary handle.

In one embodiment, the second opposite end of the contoured blade is manufactured in widths of one-quarter inch, one-half inch, three-quarter inch and one inch, but otherwise, all of the same characteristics of rigidity, outside edge position relative to the handle, as each other.

In one embodiment, the proprietary handle relative to the contoured blade first end provides a center of gravity that is uniform to the center of the first attached end of the blade. In this embodiment, the attachment end of the blade is thicker and more substantial than the second opposite end of the blade, irrespective of the width chosen for the second end of the blade. This allows the user a comfortable ergonomic grip to wield the contoured blade securely, uniformly, and easily.

In one embodiment, the contoured blades are manufactured with different rigidities, depending on the specific purpose. For example, a stiffer blade could be used for scraping, a flexible blade for spreading spackle, and a rubberized blade for grouting.

In one embodiment, the device as described herein could comprise a set of blades, rotatably mounted in the handle, so that the user could rotate into position the desired blade, which could be chosen because of its width or because of its flex properties. Because the contoured blades are relatively thin, any number of blades could be attached.

EXAMPLES

The present invention is further illustrated, but not limited by, the following examples.

In a typical construction or remodeling job, there will exist narrow, obstructed areas where a broad spackling knife cannot easily fit. Applying spackle in gaps or around pipes and other obstructions can be awkward, and achieving a flawless result in this circumstance is difficult with existing tools.

Choosing a contoured knife blade with an ergonomic handle as described herein overcomes this problem. The handle allows the user to hold the contoured blade in a way that the contoured blade can reach the odd area without the user's hand getting in the way, or the blade itself not being able to fit or be positioned correctly.

For example, consider an area to the left or right of a door casing that is close to a wall. In this situation, there is a small gap, hard to get to. A user's hand cannot line up correctly because it hits the adjacent wall and the gap of space cannot accommodate a typical broad spackle knife. The installer could remove the door casing to get a flat surface, but this is very time consuming and putting it back exactly in position is difficult. The contoured blade, offset from the handle, allows an installer to hold the tool without hitting his or her hand against the adjacent wall and the choice of smaller width blades allows the blade to be chosen to fit the gap.

The foregoing example can apply in a variety of applications—spackling, jointing, sealing, grouting,—virtually anywhere hard to reach and odd shaped, small areas need spackling, grouting, etc. This is virtually every construction job.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A device comprising:

a proprietary handle, further comprising, a bulbous, circular, disc, and symmetrical shape configured with a center indentation wherein a recess allows the device to be secured and utilized, and a hollow portion configured to allow an insertion and securement of a knife blade;

said knife blade being a contoured blade further comprising a first end configured to attach to the proprietary handle, a contoured, elongated, and partially sinuous, offset shape leading to a second elongated, rectangular end which has a predefined width and an outside edge that extends beyond an outer circumferential edge of the proprietary handle that is in the same plane as extends from said outside edge of said elongated, rectangular second end.

2. The device of claim 1, wherein the predefined width of the second end of the contoured blade is chosen from a group consisting of: one-quarter inch, one-half inch, three-quarters inch, and one inch.

3. The device of claim 1, wherein the proprietary handle is plastic and the contoured blade is aluminum.

4. The device of claim 1, wherein the contoured blade is stiff.

5. The device of claim 1, wherein the contoured blade is flexible.

6. The device of claim 1, wherein the contoured blade has a rubber surface on one side.

7. A device comprising:

a proprietary handle, further comprising, a bulbous, circular, disc and symmetrical shape configured with a center indentation wherein a recess allows the device to be secured and utilized, and a hollowed circumference portion configured to allow an insertion and securement of a plurality of knife blades rotatably mounted;

said plurality of knife blades being a plurality of contoured blades, each further comprising a first end configured to attach to the proprietary handle and be rotatable when attached, each having a contoured, elongated, and partially sinuous, offset shape leading to a second elongated, rectangular end which has a predefined width and an outside edge that extends beyond an outer circumferential edge of the proprietary handle that is in the same plane as extends from said outside edge of said elongated, rectangular second end, and each of said plurality of knife blades being rotatably mounted and configured to allow one blade at a time to be positioned for use.

* * * * *